US005993225A

United States Patent [19]

Johnson et al.

[11] Patent Number: 5,993,225

[45] Date of Patent: Nov. 30, 1999

[54] SELECTABLE POWER SUPPLY DEVICE

[75] Inventors: Terry Johnson, Plymouth; Eric Peterson, Lino Lakes, both of Minn.

[73] Assignee: A.M.P. Manufacturing & Supply, Inc., Minneapolis, Minn.

[21] Appl. No.: 08/970,188

[22] Filed: Nov. 14, 1997

[51] Int. Cl.[6] ..... H01R 13/44

[52] U.S. Cl. ..... 439/136; 439/218

[58] Field of Search ..... 439/135, 218, 439/221, 222, 136; 200/16 C, 5 B, 5 EB, 16 E

[56] References Cited

U.S. PATENT DOCUMENTS 1,798,895 3/1931 Noffs .
2,966,560 12/1960 Gluck .
3,174,002 3/1965 Golbeck .
3,555,213 1/1971 Cherry .
4,012,608 3/1977 Lockard .
4,204,104 5/1980 Quigley .
4,816,626 3/1989 Valenzona et al. .
4,825,020 4/1989 Rao et al. .
5,051,549 9/1991 Takano .
5,051,552 9/1991 Hou et al. .
5,322,983 6/1994 Tseng .
5,324,958 6/1994 Mead et al. .
5,350,894 9/1994 Allison .

*Primary Examiner*—Neil Abrams
*Assistant Examiner*—Javaid Nasri
*Attorney, Agent, or Firm*—Janet Peyton Schafer

[57] ABSTRACT

A selectable power supply for switching between normal and emergency standby power supply. The device is used where two power sources are used, such that only one power supply source can feed the electrical load. A sliding shuttle is used to permit access to the source of power to feed the load at any time.

1 Claim, 3 Drawing Sheets

SELECTABLE POWER SUPPLY DEVICE

BACKGROUND

The present invention relates to switching devices and more particularly to a sliding shuttle apparatus allowing switching between normal and emergency standby power supplies while simultaneously preventing overloading of the electrical system.

Numerous sliding switches have been provided in prior art that are adapted to include sliding switch mechanisms having a sliding actuator that touches a contactor, for example, Hou et al., U.S. Pat. No. 5,051,552 is illustrative of such prior art. Tseng, U.S. Pat. No. 5,322,983, teaches an electrical switch having a sliding block that manually switches between two positions, on and off. Takano, U.S. Pat. No. 5,051,549, teaches a sliding switch having a movable conductor which, when in its first position in contact with a pair of elongate fixed conductors, completes an electrical circuit therebetween.

None of the prior art sliding switches address the problem of permitting only one power source to be used at any one time thereby preventing overload of an electrical system which would occur if two power sources, the normal power source and the back-up emergency power source, were inadvertently accessed simultaneously.

While these prior art switches may be suitable for the particular purpose to which they address, they would not be as suitable for the purposes of the present invention as hereinafter described.

SUMMARY

The present invention is directed to a selectable power supply device that satisfies these needs to provide an apparatus to interlock two pullout switches such that only one switch can be on at one time allowing only one power source to feed the electrical load. A selectable power supply device having features of the present invention includes a two-piece apparatus having as a first piece a bracket for mounting between two pullout switches in an enclosure such as a current transformer box. The apparatus includes as a second piece, a sliding shuttle that will allow only one pullout switch head unit to be installed at any time allowing only one source of power to feed the electrical load.

It is an object of the present invention to provide a simple, economical switching device that permits selection between a normal electrical source and a standby electrical load while preventing inadvertent simultaneous access to both normal and standby electrical sources.

BRIEF DESCRIPTION OF THE DRAWINGS

Understanding of the invention will be enhanced by referring to the accompanying drawings, in which like numbers refer to like parts in the several views and in which.

DETAILED DESCRIPTION OF THE CURRENTLY PREFERRED EMBODIMENTS

Understanding of the invention will be further enhanced by referring to the following illustrative but nonlimiting example.

Figure 1:
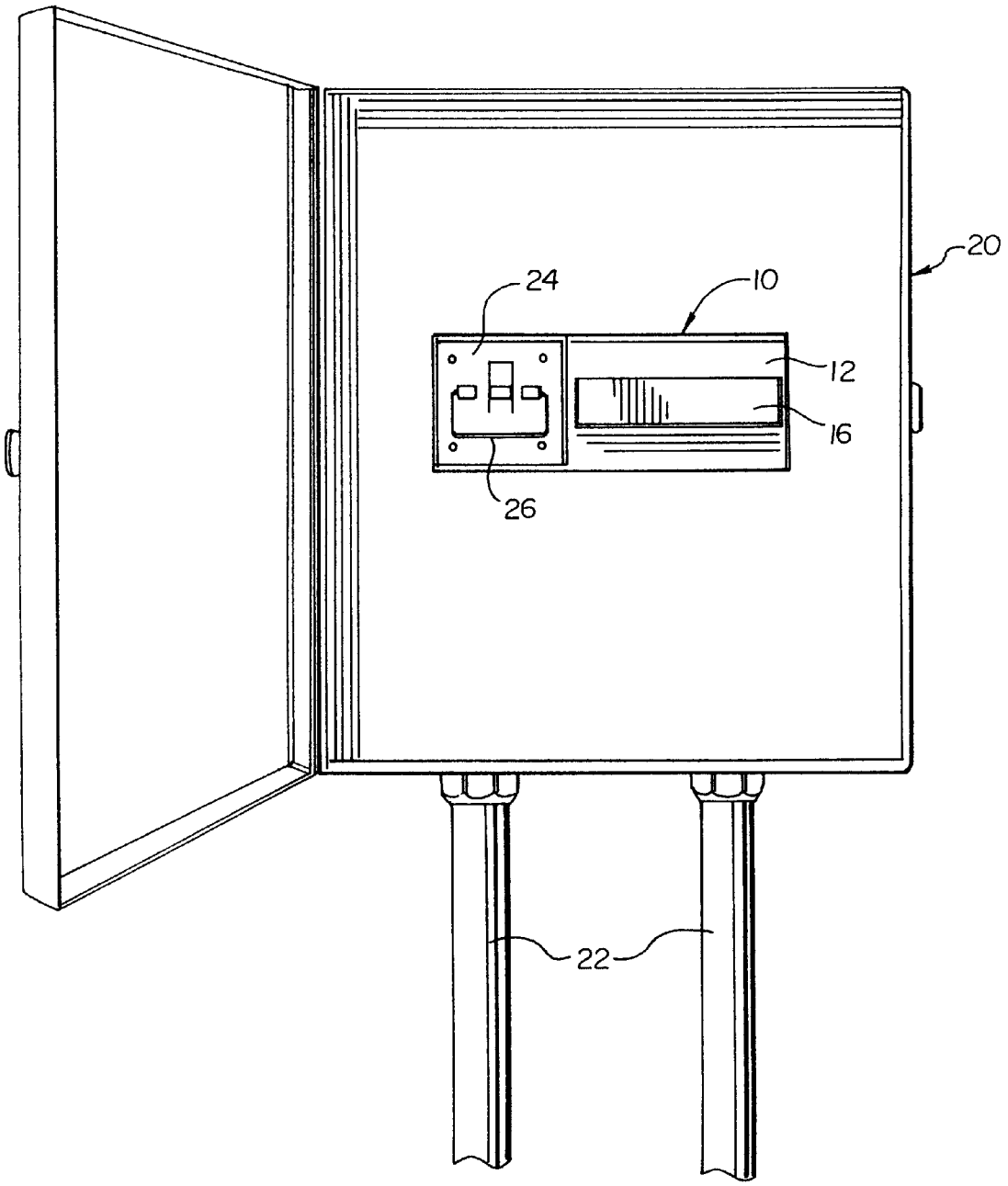
FIG. 1 is a perspective view of the apparatus in its place of use in an enclosure.
Figure 2:
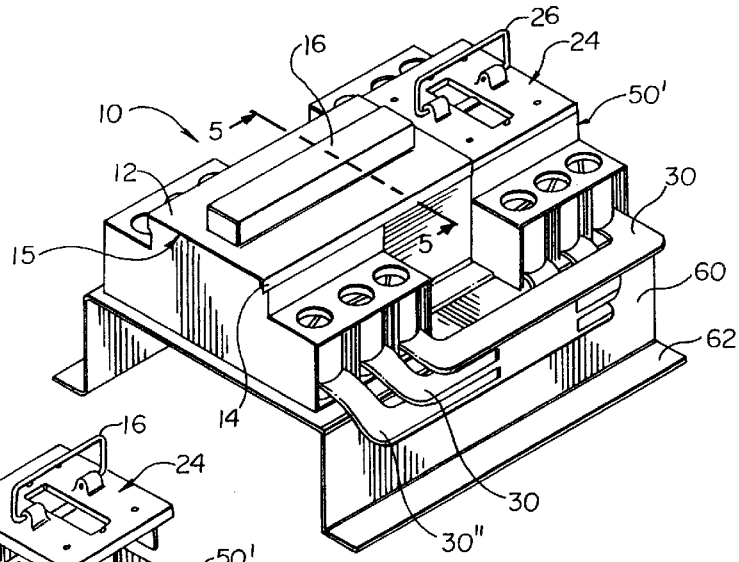
FIG. 2 is a side perspective view of the apparatus blocking access to a first power supply source with the pull-out switch inserted in a second power supply source.
Figure 3:
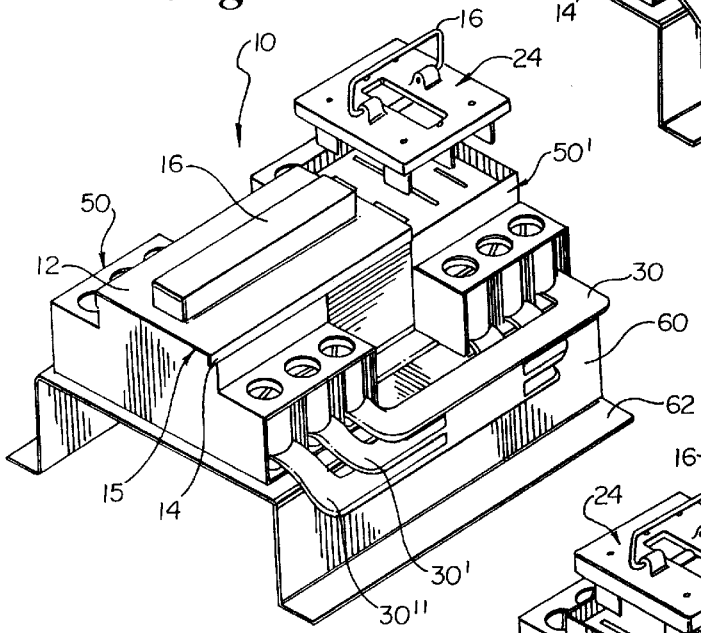
FIG. 3 is a side perspective view with the pull-out switch removed from a second power supply source.
Figure 4:
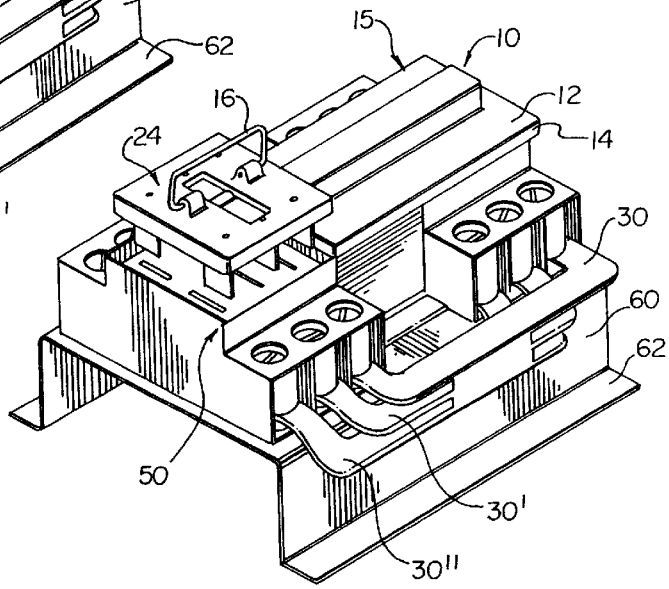
FIG. 4 is a side perspective view of the apparatus blocking access to a second power supply source with the pull-out switch inserted in a first power supply source.
Figure 5:
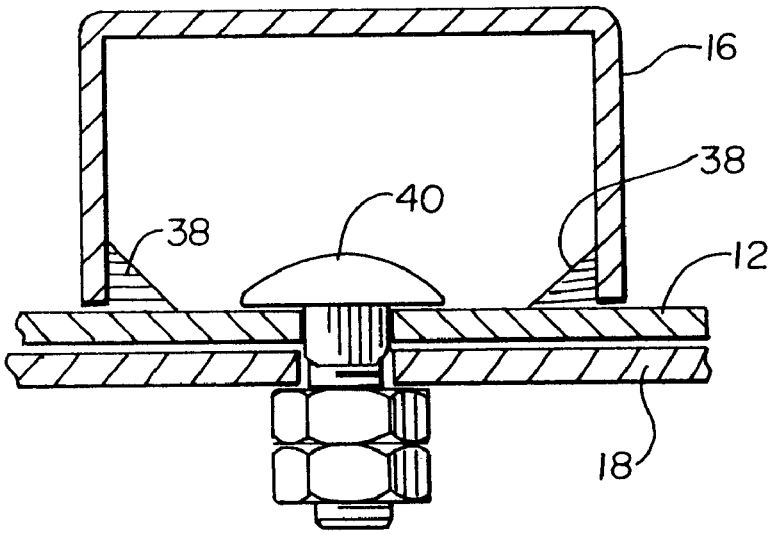
FIG. 5 is a cross-sectional view of the handle showing its attachment to sliding shutter.

Turning now to the drawings, in which like reference characters refer to corresponding elements throughout the several views, FIG. 1 illustrates the device of the current invention, a selectable power supply device 10, in its place of use within an enclosure, or switch box 20, mounted vertically on a flat surface, such as a wall, not shown. A pair of circuit containing conduits 22 are shown mounted adjacent the switch box 20 for providing power to the device box 20. The selectable power supply switch 10 is shown mounted within the switch box 20. The selectable power supply device 10 is mounted for horizontal movement between a pair of power supply units 50,50' and permits selection between the normal power supply and a back-up emergency power while preventing simultaneous access to both power supply sources. A conventional pull-out switch head unit 24, having a pull-out handle 26, is shown in FIGS. 2–4. Selectable power supply device 10 prevents use of more than one pull-out switch head unit 24 at a time.

Sliding shuttle 15, as shown in detail in FIGS. 2–4, has a flat, rectangular-shaped body with a top surface 12 and having two side edges 14. Shuttle 15 of 14 gauge galvanized steel has been used and works well although other fire retardant materials, such as plastic or fiberglass, could be used.

Figure 6:
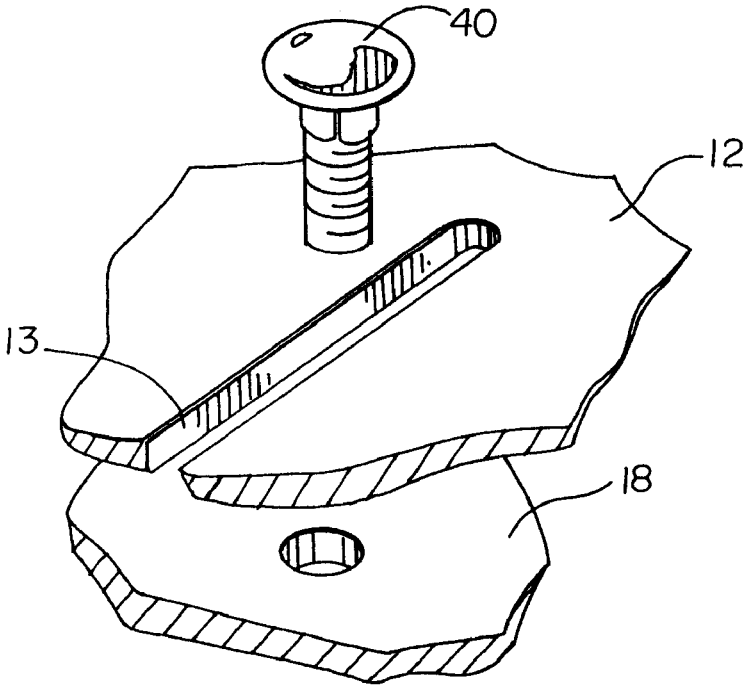
FIG. 6 is an exploded fragmented view of the handle attachment and aperture permitting sliding shutle device to be mmoved from a first position exposing a first power supply unit to a second position exposing a second power supply unit.

An aperture 13 is formed centrally along the length of top surface 12, shown in part at FIG. 6. Handle 16 is raised above, and fastened, in actual use conditions by welds 38, to top surface 12, and covers slot 13, shown at FIG. 6. Bracket 18 is fixedly attached by fastening means attached to flange edge 19 thereof to switch box 20 between power supply units 50,50'. Slot 13 enables sliding shuttle 15 to be slidably attached, by means of a pair of fasteners to bracket 18. A pair of bolts 40 and nuts 42 have been used and work well although other fastening means could be used. When selectable power supply device 10 is positioned for use, inverted U-shaped bracket 18 is fastened, by means of nut and bolt, or other fasteners, in a position between two power supply units 50,50', the bracket 18 providing support for sliding shuttle 15. The assembled selectable power supply switch 10 and power supply units 50,50' are attached to switch box 20 in a horizontal position as shown in FIG. 1, by inverted U-shaped mounting base 60 and fastening means such as nuts and bolts, or other fastening means, attaching mounting base 60 along a flange 62 on two long sides of mounting base 60 to switch box 20.

Once assembled and positioned, bracket 18 in a position between the two power supply units 50, 50', sliding shuttle 15 may be manually moved from a first position, covering first power supply unit 50, shown at FIG. 2, to a second position covering second power supply unit 50', shown at FIG. 4.

In use, selectable power supply switch 10 is mounted by fastening means onto a conventional switch box 20 such that bracket 18 is fastened by bolts or other fastening means through flange 19 onto switch box 20, as shown in FIGS.

2–4. Once in position, backet 18 is stationary. Sliding shuttle 15 is mounted on bracket 18 and sliding shuttle 15 is manually moved in a plane perpendicular to bracket, by means of handle 16, to a position covering one opening on a power supply unit 50. The dimensions of sliding shuttle 15 are such that only one opening on a power supply unit 50 may be accessed at any given time. With one power supply unit 50 or 50' blocked, only one pull-out shitch head 24 may be inserted into power supply unit. In the FIG. 2, back-up power supply source 50' has pull-out switch head 24 inserted therein with sliding shuttle 15 blocking access to normal power supply source 50. In FIG. 4, the back-up power supply source 50' is blocked by sliding shuttle 15 permitting access to normal power supply source 50 only. If access were permitted to both power supply sources simultaneously, an explosion would occur as a result of the power overload.

Although the present invention has been described in considerable detail with reference to certain preferred versions thereof, other versions are possible. Therefore, the spirit and scope of the appended claims should not be limited to the description of the preferred versions contained herein.

What is claimed is:

1. An apparatus for selecting between normal power supply and back-up emergency power supply in an electrical switch box, comprising:

a) a stationary bracket for mounting to the switch box, said bracket having a bracket flange edge;

b) a shuttle, slidably attached to said stationary bracket, for permitting selection between the normal power supply and the back-up emergency power supply while preventing simultaneous access to both power supply sources;

c) fastening means, wherein said stationary bracket is fixedly mounted to the switch box by fastening means along said bracket flange edge;

d) a handle, formed on an upper surface of said shuttle, for manually sliding said shuttle on said stationary bracket; and e) a slot, formed on said upper surface of said shuttle, said slot for receiving fastening means attaching said shuttle to said stationary bracket, said fastening means permitting said shuttle to slidable attach to said stationary bracket in a place perpendicular to an axis defined by said fastening means.

* * * * *